US006135213A

United States Patent [19]

Schoeps

[11] Patent Number: 6,135,213

[45] Date of Patent: Oct. 24, 2000

[54] PNEUMATIC POWER WRENCH WITH ADJUSTABLE EXHAUST RESTRICTION

[75] Inventor: Knut Christian Schoeps, Tyresö , Sweden

[73] Assignee: Atlas Copco Tools AB, Nacka, Sweden

[21] Appl. No.: 09/141,667

[22] Filed: Aug. 28, 1998

[30] Foreign Application Priority Data

Sep. 3, 1997 [SE] Sweden ..... 9703163

[51] Int. Cl.[7] ..... B25B 19/00; B25F 5/02

[52] U.S. Cl. ..... 173/93.5; 173/169

[58] Field of Search ..... 173/93, 93.5, 93.6, 173/168, 169, 170

[56] References Cited

U.S. PATENT DOCUMENTS

| | | | |
|---|---|---|---|
| 3,299,781 | 1/1967 | Law | 173/169 |
| 3,924,961 | 12/1975 | Hess et al. | 173/169 |
| 4,778,015 | 10/1988 | Jacobsson | 173/170 |
| 5,531,279 | 7/1996 | Biek | 173/93.5 |
| 5,544,710 | 8/1996 | Groshans et al. | 173/93.5 |
| 5,591,070 | 1/1997 | Kachlich | 173/169 |
| 5,797,462 | 8/1998 | Rahm | 173/169 |
| 5,901,794 | 5/1999 | Schoeps et al. | 173/93.5 |
| 5,918,686 | 7/1999 | Izumisawa | 173/169 |

*Primary Examiner*—Scott A. Smith

*Attorney, Agent, or Firm*—Frishauf, Holtz, Goodman, Langer & Chick, P.C.

[57] ABSTRACT

A pneumatic power wrench having a rotation motor supported in a housing (11), an output shaft (13) for connection to a screw joint to be tightened, a pressure air inlet passage (14) controlled by a throttle valve (18), and an exhaust air outlet passage (16) including an automatic outlet flow restricting valve (26,28,43), wherein the outlet flow restricting valve (26,28,43) comprises a valve seat (26), a freely movable valve element (28,43) co-operating with the seat (26), a first activation surface (45) on the valve element (28,43) communicating with the inlet passage (14) downstream of the throttle valve (18) for exerting a motor feed pressure responsive actuating force on the valve element (28,43) in a direction away from the seat (26), and a bias spring (49) and a second outlet flow responsive activation surface (33) for actuating the valve element (28,43) in a direction toward the seat (26). The flow restricting valve (24,43) is included in an exhaust air outlet deflector (20) attached to the housing (11).

32 Claims, 3 Drawing Sheets

PNEUMATIC POWER WRENCH WITH ADJUSTABLE EXHAUST RESTRICTION

BACKGROUND OF THE INVENTION

This invention relates to a power wrench of the type having a housing with a pneumatic rotation motor drivingly connected to an output shaft, a pressure air inlet passage and an exhaust air outlet passage in the housing, a manually operable throttle valve located in the air inlet passage, and an adjustable exhaust air flow restricting valve in the outlet passage.

In prior art, manually adjustable exhaust flow restricting valves have been used for reducing the idle or low-load speed of power wrench motors, thereby reducing the risk for overtighten stiff screw joints and for avoiding premature motor shut-off at such joints. Particularly at the impulse type of tools there is a problem with a premature shut-off, because when tightening a stiff joint the very first impulse generated will be of a very high magnitude as a result of a high running down speed. There is also a risk that the target torque level is reached and even passed by such an initial high energy impulse.

Previously known exhaust flow restriction valves at power wrenches are of two main types, namely I)the manually adjustable type, which is intended to be selectively set in a number of alternative positions with varying flow restricting action, and II)the self-adjusting type controlled by the actual exhaust flow acting on a valve element in the opening direction against a spring biassing the valve element in the closing direction.

Both of these two previously known types of exhaust flow restricting devices have been found less satisfactory. The manually adjustable type of valve is disadvantageous in that the restriction area set before starting the tool and causes an outlet flow restriction and a motor speed limitation not only at idle running or at low-load operation, but causes a power output limitation also at lower speed levels, i.e. during the final tightening of a screw joint. This means that the full capacity of the power wrench is not available during the final tightening stage.

The self-adjusting type of restriction valve on the other hand has turned out to be very difficult to make work properly at different air pressure and outlet flow levels. Accordingly, this type of valve is very sensitive to changing exhaust flow magnitudes and has a tendency to restrict the flow too much or too little. The intended automatic continuous adjustability of this type of valve is very difficult to obtain.

SUMMARY OF THE INVENTION

In order to accomplish an automatically adjustable exhaust flow restricting valve by which the above discussed problems are avoided, the present invention suggests a power wrench provided with an automatic pressure controlled restriction valve as recited in the following claims.

A preferred embodiment of the invention is described in detail hereinbelow with reference to the accompanying drawings.

DESCRIPTION OF THE PREFERRED EMBODIMENT

Figure 1:
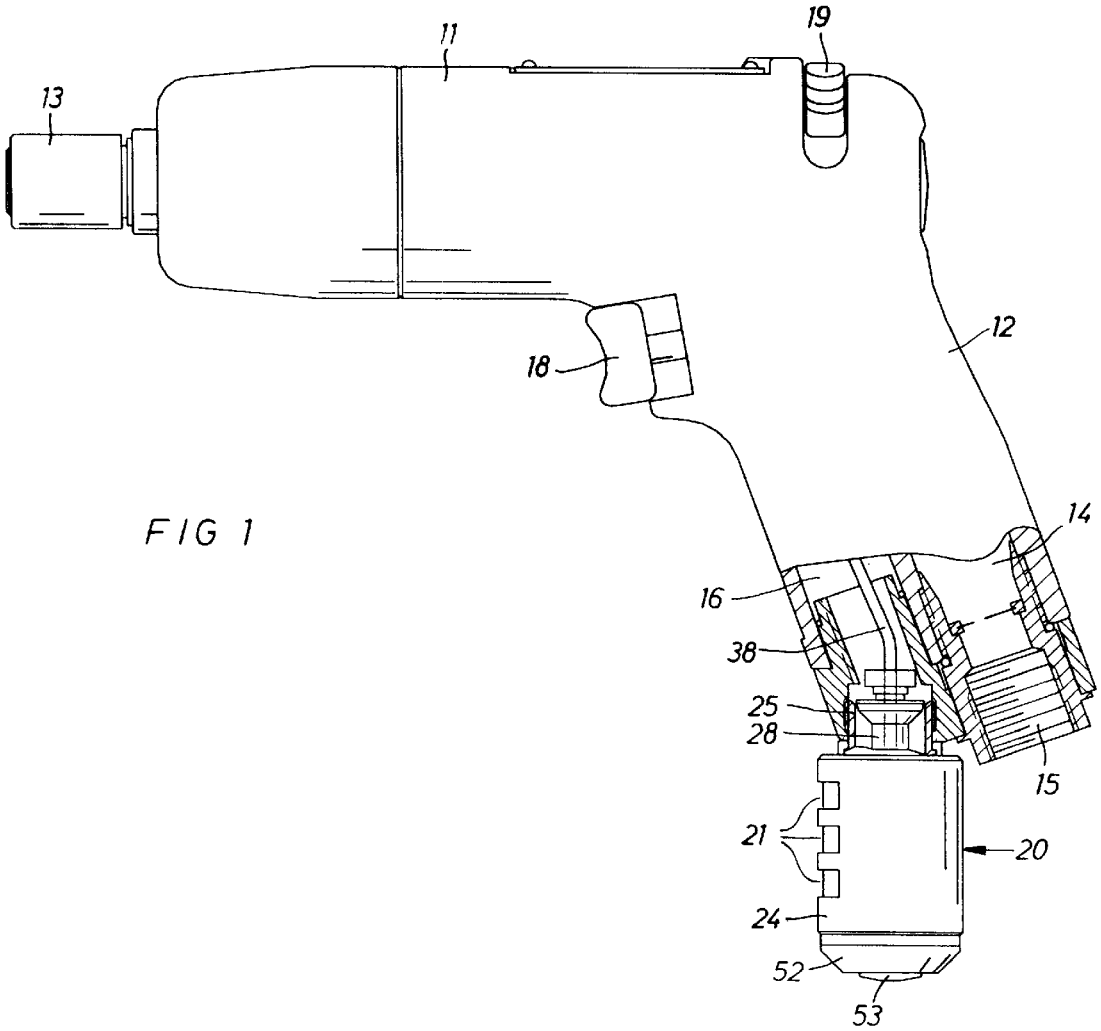
FIG. 1 shows a side view, partly in section, of a pneumatic power wrench according to the invention.

The power wrench shown in the drawings comprises a housing 11 provided with a pistol type handle 12, a reversible pneumatic rotation motor (not shown in detail) drivingly connected to an output shaft 13, a pressure air inlet passage 14 connectable to a pressure air supply line via a hose connection 15, and an exhaust air outlet passage 16.

The pressure air supply to the motor is controlled by a throttle valve 18 (not shown in detail) which is located in the inlet passage 14 and which is manoeuvrable by a trigger type push button. Downstream of the throttle valve 18, there is provided a reverse valve 19 (not shown in detail) which is manually shiftable by means of a knob on top of the housing 11. By the reverse valve 19, the pressure air supply to the motor may be shifted so as to make the motor change direction of rotation.

At the downstream end of the air outlet passage 16, there is mounted an outlet flow deflecting unit 20 which comprises outlet openings 21, an exhaust silencing sleeve 22 and includes an automatic exhaust air outlet flow restricting valve. The unit 20, which forms a part of the outlet passage 16, comprises a cylindrical casing 24 having a threaded neck portion 25 by which the unit 20 is secured to the lower end of the handle 12. The neck portion 25 defines an inner valve seat 26 which forms part of the outlet flow restricting valve.

The exhaust silencing sleeve 22 is of a conventional design and comprises an inner element of a porous sintered plastic material surrounded by a brass wire screen.

Figure 2:
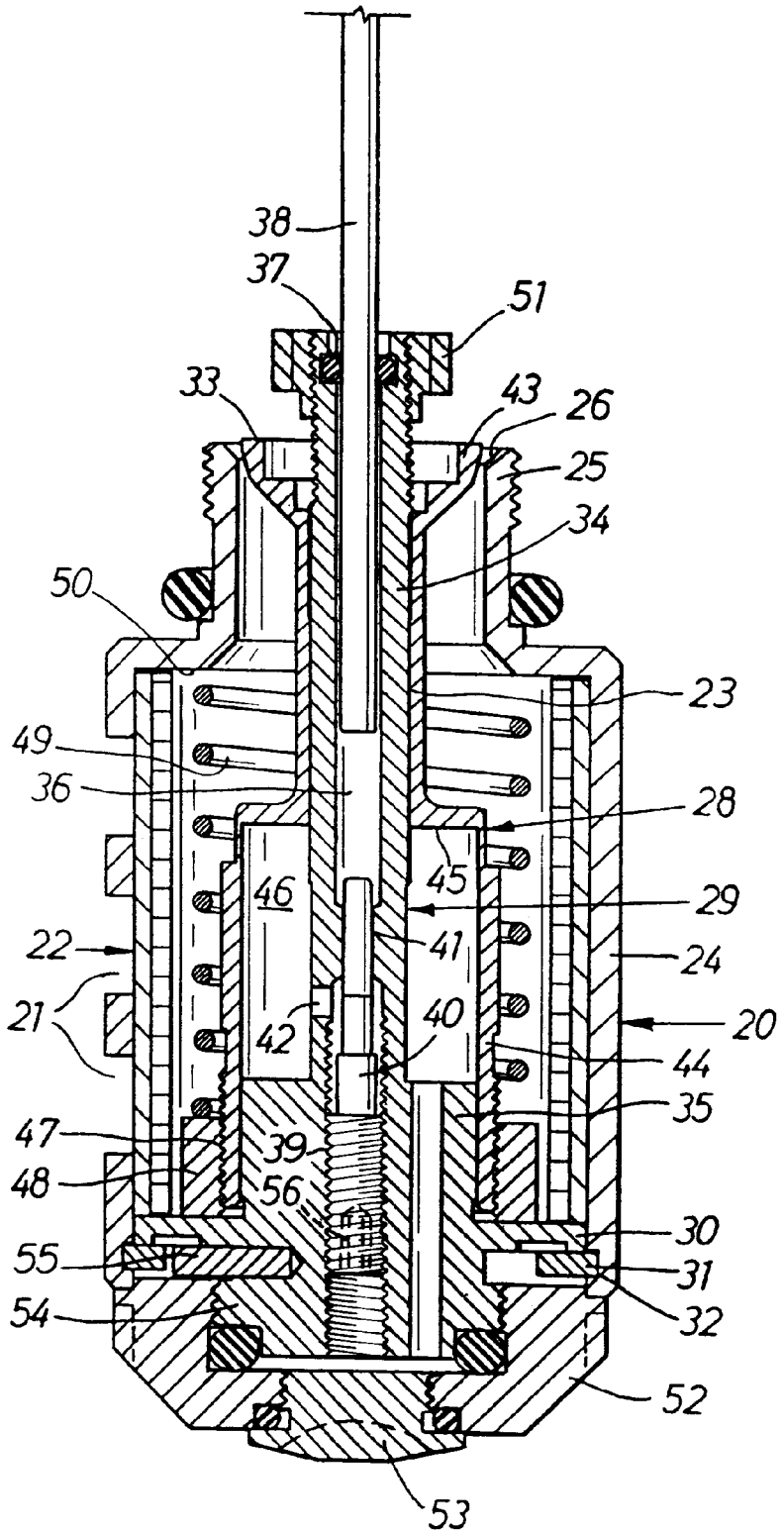
FIG. 2 shows a longitudinal section through an outlet flow restricting valve according to the invention.

The outlet flow restricting valve according to the invention as illustrated in FIG. 2 comprises a tubular valve element 28 which is movably guided on a spindle 29. The latter extends coaxially through the casing 26 and is formed with a radial flange 30 forming a transverse end wall at the lower end of the casing 24. The spindle 29 is retained to the casing 26 in that the flange 30 is axially confined between a lock ring 31 inserted in a circumferential groove 32 in the casing 26 and the silencing sleeve 22.

The spindle 29 is formed with a relatively long small diameter portion 34 and a relatively short large diameter portion 35, and a coaxial bore 36 extends throughout the entire length of the spindle 29. At its upper end, the bore 36 carries an O-ring 37 to sealingly receive a pressure air supply tube 38 connected to the air inlet passage 14. In its lower part the bore 36 is provided with a thread 39 carrying a valve needle 40. The latter is arranged to cooperate with a seat portion 41 in the bore 36 to form an adjustable air flow restriction. A lateral opening 42 on the spindle 29 connects the bore 36 downstream of the seat portion 41 with the outside of the spindle 29.

The valve element 28 comprises tubular central portion 23, a valve head 43 and a cup-shaped lower portion 44. The central portion 23 is slidingly guided on the small diameter portion 34 of the spindle 29, and the valve head 43 is arranged to co-operate with the valve seat 26 to, thereby, control the exhaust air flow through the neck portion 25 of the casing 24. The valve head 43 defines an activation surface 33 to be pressurized by the exhaust pressure in the outlet passage 16.

The cup-shaped portion 44 of the valve element 28 is slidingly guided on the large diameter portion 35 of the spindle 29. Between the cup-shaped portion 44 and the large diameter portion 35 of the spindle 29 there is formed an actuator chamber 46 which is to be fed with pressure air via the tube 38, the bore 36, the needle valve 40,41 and the opening 42. The valve element 28 is formed with an internal axially facing activating surface 45 which accordingly, is arranged to be pressurized by the motor inlet pressure fed to the actuator chamber 46. This is described in further detail below.

At its lower end, the valve element 28 has an outer thread 47 on which a ring element 48 is adjustably mounted. The ring element 48 is intended both to form a support for a bias spring 49 and to form an abutment for defining the lower end position of the valve element 28 by engaging the flange 30 of the spindle 29. The spring 49 takes support against an inner shoulder 50 in the casing 26 and acts to bias the valve element 28 towards the lower end position in which the valve head 43 occupies its closest position relative to the seat 26. The upper end position of the valve element 28 is defined by an adjustable stop nut 51 threaded onto the upper end of the spindle 29.

At its lower end, the casing 24 is closed by an end cover 52 in which is threaded a central plug 53. The end cover 52 is threaded onto a lower extension 54 of the spindle 29. In order to prevent the spindle 29 from rotating when mounting the end plug 52 thereon, there is provided a radial lock pin 55.

At its lower end, the valve needle 40 is formed with an inner hexagon 56 to be engaged by a hexagon key for adjustment of the needle valve opening area. To get access to the needle hexagon 56 the plug 53 has to be removed.

In operation of the power wrench, the output shaft 13 is coupled to a screw joint to be tightened and the air inlet passage 14 is connected to a pressure air source via the hose connection 15. By activating the throttle valve 18, the motor is supplied with pressure air and starts rotating the output shaft 13. During the initial stage of the tightening process, the torque resistance from the screw joint is very low and the rotation speed as well as the air flow through the motor increase rapidly. This means that the back pressure from the motor and the feed pressure in the inlet passage 14 is relatively low.

This relatively low inlet pressure during the initial operation sequence, results in a relatively low pressure is being transferred to the actuator chamber 46 via the tube 38, the bore 36, the needle valve 40,41 and the opening 42. This relatively low activating pressure produces a force on activating surface 45 of the valve element 28 that is effective only to displace the valve head 43 just a small distance relative to the seat 26, thereby letting through a restricted air flow only. The pneumatic activating force acting on the activating surface 45 is partly balanced by the bias force of the spring 49. However, the pressure drop across the valve head 43 generates a force on the activation surface 33 of the valve head 43 which acts in the same direction as the spring 49. This means that during the starting phase of the motor, the valve element 28 is displaced a very short distance from its lower end position. This results in the valve head 43, in cooperation with the seat 26, forming a small area opening and allows a restricted outlet flow only through the neck portion 25.

This initial limited opening area of the exhaust valve results in a substantial reduction of the motor speed during the screw joint running down phase. The initial screw joint running down speed would otherwise have been very high, and the risk for overtighten a stiff screw joint would have been great due to high kinetic energy stored in the rotating parts of the tool.

As the tightening process proceeds, the torque resistance from the screw joint increases and the motor load as well as the pressure in the air inlet passage 14 increases accordingly. This results in the air pressure fed to the actuator chamber 46 via the tube 38 is increased, and the valve head 43 is displaced further away from the valve seat 26. Thereby, the pressure drop across the valve head 43 and the subsequent activation force on the surface 33 in the closing direction of the valve element 28 decreases.

At the final tightening stage, i.e. when approaching the target torque level, the motor feed pressure is at its maximum level, and due to a low motor speed the exhaust flow is low as well. A high pressure in the actuator chamber 46 in combination with a low pressure drop across the valve head 43 results in the valve element 28 occupies its fully open position. This means that the outlet flow is now unrestricted, which in turn means that the motor is able to operate at its full power output capacity.

The setting of the needle valve 40,41 shall be adapted to the leakage flow always existing along the guide surfaces of the valve element 28. Due to varying clearances between the valve element 28 and the spindle 29, resulting from scattering manufacturing tolerances and illustrated schematically by the numeral 60 in FIG. 3, the valve needle 40 has to be adjusted to obtain a desireable pressure level in the actuator chamber 46 and a subsequent desireable action of the exhaust valve. This needle setting is carried out at the assemblage of the tool.

Figure 3:
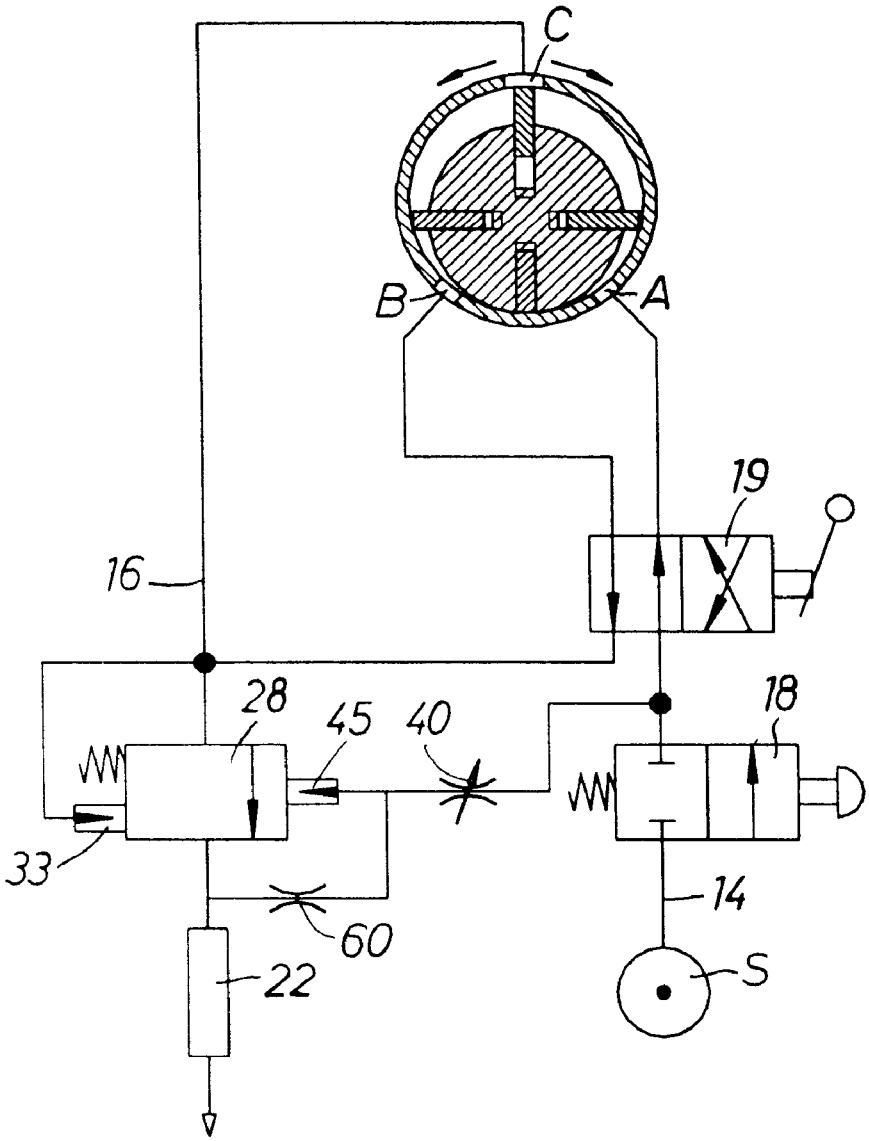
FIG. 3 shows schematically the pneumatic circuitry of the power wrench according to the invention.

In order to more clearly illustrate the motor operating features, FIG. 3 shows a pneumatic circuitry for a reversible power wrench.

The illustrated tool motor has two service ports A and B and a primary exhaust port C. Since the motor is of the reversible type, illustrated by two oppositely directed arrows, the service ports A and B act alternatively as inlet ports or as secondary exhaust ports. The reverse valve 19, which is connected to a pressure air source S via the throttle valve 18, feeds pressure air alternatively to port A or port B. The other one of the ports A and B which is not being fed with pressure air acts as a secondary exhaust port. In order to ensure pressure air supply to the exhaust flow restricting valve, no matter the actual position of the reverse valve 19, the actuator chamber 46 is connected via the tube 38 to the air inlet passage 14 upstream of the reversing valve 19.

By the exhaust restriction valve according to the invention, the exhaust air outlet flow from the motor is automatically and continuously restricted in response to an increasing motor speed and a corresponding decreasing motor feed pressure, which means that the risk for overtighten stiff screw joints by influence of tool inertia forces is substantially reduced.

The invention is not limited to the above described examples, but may be freely varied within the scope of the invention.

It should be pointed out that the invention is particularly suitable for use at impulse wrenches where the automatic pressure controlled outlet flow restriction is effective to prevent overtightening stiff joints by the very first impulse delivered. In case of impulse wrenches provided with automatic shut-off means, the exhaust flow restriction device according to the invention also prevents premature shut-off of the tool motor.

I claim:

1. Pneumatic power wrench, including a housing (11), a pneumatic rotation motor drivingly connected to an output shaft (13), a pressure air inlet passage (14) and an exhaust air outlet passage (16) in said housing (11), a manually operable throttle valve (18) located in said inlet passage (14), and an adjustable exhaust air outlet flow restricting valve (26,28,43) located in said outlet passage (16), for controlling the motor outlet pressure, chararecterized in that said flow restricting valve (26,28,43) comprises a valve seat (26) immovably arranged relative to said housing (11), and a valve element (28,43) which is freely movable relative to said housing (11) and arranged to cooperate with said valve seat (26), said valve element (28,43) has a first activating surface (45) communicating with said air inlet passage (14) downstream of said throttle valve (18) and arranged to actuate said valve element (28,43) in a direction away from said valve seat (26), and a spring (49) arranged to bias said valve element (28,43) in a direction toward said valve seat (26).

2. Power wrench according to claim 1, wherein said motor is reversible and has two alternative air inlet ports (A;B), a reversing valve (19) located between said throttle valve (18) and said motor for connecting said air inlet passage (14) to either one of said two alternative inlet ports (A;B), wherein said first activating surface (45) communicates with said air inlet passage (14) upstream of said reversing valve (19).

3. Power wrench according to claim 2, wherein said valve element (28,43) comprises a second activating surface (33) communicating with said outlet passage (14) and arranged to actuate said valve element (28,43) in a direction toward said valve seat (26) in response to the actual exhaust pressure.

4. Power wrench according to claim 3, wherein said valve element (28,43) is tubular in shape, and said valve seat (26) is annular in shape and located in said outlet passage (16).

5. Power wrench according to claim 4, wherein said outlet passage (16) comprises an outlet flow deflecting unit (20) attached externally on said housing (11), said exhaust flow restricting valve (26,28,43) is included in said outlet flow deflecting unit (20).

6. Power wrench according to claim 5, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

7. Power wrench according to claim 6, wherein said valve seat (26) is located in said neck portion (25).

8. Power wrench according to claim 3, wherein said outlet passage (16) comprises an outlet flow deflecting unit (20) attached externally on said housing (11), said exhaust flow restricting valve (26,28,43) is included in said outlet flow deflecting unit (20).

9. Power wrench according to claim 8, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

10. Power wrench according to claim 9, wherein said valve seat (26) is located in said neck portion (25).

11. Power wrench according to claim 2, wherein said valve element (28,43) is tubular in shape, and said valve seat (26) is annular in shape and located in said outlet passage (16).

12. Power wrench according to claim 9, wherein said outlet passage (16) comprises an outlet flow deflecting unit (20) attached externally on said housing (11), said exhaust flow restricting valve (26,28,43) is included in said outlet flow deflecting unit (20).

13. Power wrench according to claim 12, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

14. Power wrench according to claim 13, wherein said valve seat (26) is located in said neck portion (25).

15. Power wrench according to claim 2, wherein said outlet passage (16) comprises an outlet flow deflecting unit (20) attached externally on said housing (11), said exhaust flow restricting valve (26,28,43) is included in said outlet flow deflecting unit (20).

16. Power wrench according to claim 15, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

17. Power wrench according to claim 16, wherein said valve seat (26) is located in said neck portion (25).

18. Power wrench according to claim 1, wherein said valve element (28,43) comprises a second activating surface (33) communicating with said outlet passage (14) and arranged to actuate said valve element (28,43) in a direction toward said valve seat (26) in response to the actual exhaust pressure.

19. Power wrench according to claim 18, wherein said valve element (28,43) is tubular in shape, and said valve seat (26) is annular in shape and located in said outlet passage (16).

20. Power wrench according to claim 19, wherein said outlet passage (16) comprises an outlet flow deflecting unit (20) attached externally on said housing (11), said exhaust flow restricting valve (26,28,43) is included in said outlet flow deflecting unit (20).

21. Power wrench according to claim 20, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

22. Power wrench according to claim 21, wherein said valve seat (26) is located in said neck portion (25).

23. Power wrench according to claim 18, wherein said outlet passage (16) comprises an outlet flow deflecting unit (20) attached externally on said housing (11), said exhaust flow restricting valve (26,28,43) is included in said outlet flow deflecting unit (20).

24. Power wrench according to claim 23, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

25. Power wrench according to claim 24, wherein said valve seat (26) is located in said neck portion (25).

26. Power wrench according to anyone of claim 1, wherein said valve element (28,43) is tubular in shape, and said valve seat (26) is annular in shape and located in said outlet passage (16).

27. Power wrench according to claim 26, wherein said outlet passage (16) comprises an outlet flow deflecting unit (20) attached externally on said housing (11), said exhaust flow restricting valve (26,28,43) is included in said outlet flow deflecting unit (20).

28. Power wrench according to claim 27, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

29. Power wrench according to claim 28, wherein said valve seat (26) is located in said neck portion (25).

30. Power wrench according to claim 1, wherein said outlet passage (16) comprises an outlet flow deflecting unit (20) attached externally on said housing (11), said exhaust flow restricting valve (26,28,43) is included in said outlet flow deflecting unit (20).

31. Power wrench according to claim 30, wherein said outlet flow deflecting unit (20) comprises a cylindrical casing (24) provided at its one end with a coaxial tubular neck portion (25) for connection to said housing (11), and a spindle (29) is rigidly mounted in a coaxial disposition relative to said casing (24) to form a guide means for said valve element (28).

32. Power wrench according to claim 31, wherein said valve seat (26) is located in said neck portion (25).

* * * * *

UNITED STATES PATENT AND TRADEMARK OFFICE

CERTIFICATE OF CORRECTION

PATENT NO. : 6,135,213
DATED : October 24, 2000
INVENTOR(S) : Knut Christian Schoeps It is certified that error appears in the above-identified patent and that said Letters Patent is hereby corrected as shown below:

Column 5,
Line 62, change "9" to -- 11 --.

Signed and Sealed this

Ninth Day of April, 2002

*Attest:*

*Attesting Officer*

JAMES E. ROGAN
*Director of the United States Patent and Trademark Office*